US010468176B2

(12) United States Patent
Sim et al.

(10) Patent No.: US 10,468,176 B2
(45) Date of Patent: Nov. 5, 2019

(54) COMMON MODE FILTER

(71) Applicant: SAMSUNG ELECTRO-MECHANICS CO., LTD., Suwon-si, Gyeonggi-do (KR)

(72) Inventors: Won Chul Sim, Suwon-si (KR); Young Seuck Yoo, Suwon-si (KR); Hye Won Bang, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 210 days.

(21) Appl. No.: 15/286,201

(22) Filed: Oct. 5, 2016

(65) Prior Publication Data

US 2017/0287619 A1 Oct. 5, 2017

(30) Foreign Application Priority Data

Mar. 31, 2016 (KR) ..... 10-2016-0039489

(51) Int. Cl.

| | |
|---|---|
| ***H01F 5/00*** | (2006.01) |
| ***H01F 27/29*** | (2006.01) |
| ***H01F 17/00*** | (2006.01) |
| ***H01F 17/04*** | (2006.01) |
| ***H01F 27/30*** | (2006.01) |

(52) U.S. Cl.

CPC ..... *H01F 27/292* (2013.01); *H01F 17/0013* (2013.01); *H01F 17/04* (2013.01); *H01F 27/306* (2013.01)

(58) Field of Classification Search

CPC ..... H01F 17/04; H01F 27/292

USPC ..... 336/200

See application file for complete search history.

(56) References Cited

U.S. PATENT DOCUMENTS

| | | | | |
|---|---|---|---|---|
| 7,369,028 | B2 * | 5/2008 | Matsunaga | H01F 17/0013 336/200 |
| 2005/0116793 | A1 * | 6/2005 | Shoji | H03H 7/427 333/185 |
| 2006/0097835 | A1 | 5/2006 | Tomonari et al. | |

(Continued)

FOREIGN PATENT DOCUMENTS

| | | | |
|---|---|---|---|
| JP | 2006-140229 | A | 6/2006 |
| KR | 10-2013-0039400 | A1 | 4/2013 |

(Continued)

OTHER PUBLICATIONS

Office Action dated Jun. 20, 2017 in the corresponding Korean Patent Application No. 10-2016-0039489, with English language translation.

*Primary Examiner* — Ronald Hinson

(74) *Attorney, Agent, or Firm* — Morgan, Lewis & Bockius LLP

(57) ABSTRACT

A multilayer common mode filter includes: a body including a coil part having a plurality of spiral coils, wherein the coil part has one lead portion connected to one of external electrodes disposed on the body and one or more dummy lead portions each connected to the other external electrodes, and the lead portion is connected to dummy lead portions of other coil layers stacked in a thickness direction in series. Therefore, even though the common mode filter is miniaturized, the common mode filter may secure predetermined levels or more of performance and reliability.

4 Claims, 7 Drawing Sheets

(56) References Cited

U.S. PATENT DOCUMENTS

| | | | | |
|---|---|---|---|---|
| 2008/0129439 | A1* | 6/2008 | Nishikawa | H01F 17/0013 336/232 |
| 2013/0093556 | A1 | 4/2013 | Lim | |
| 2014/0285303 | A1 | 9/2014 | Cho et al. | |
| 2015/0097648 | A1* | 4/2015 | Kido | H01F 27/2885 336/200 |

FOREIGN PATENT DOCUMENTS

| | | | |
|---|---|---|---|
| KR | 10-2013-0047572 | A | 5/2013 |
| KR | 10-2014-0116678 | A | 10/2014 |

* cited by examiner

COMMON MODE FILTER

CROSS-REFERENCE TO RELATED APPLICATION(S)

This application claims benefit of priority to Korean Patent Application No. 10-2016-0039489 filed on Mar. 31, 2016 in the Korean Intellectual Property Office, the disclosure of which is incorporated herein by reference in its entirety.

TECHNICAL FIELD

The present disclosure relates to a common mode filter.

BACKGROUND

In accordance with the development of technology, electronic devices such as mobile phones, home appliances, personal computers (PC), personal digital assistants (PDA), liquid crystal displays (LCD), and the like, have changed from utilizing an analog scheme to utilizing a digital scheme, while the speeds of electronic devices have increased due to an increase in an amount of data required to be processed.

Therefore, universal serial bus (USB) 2.0, USB 3.0, and a high-definition multimedia interface (HDMI) have become widespread examples of high speed signal transmitting interfaces and are currently used in many digital devices, such as personal computers and digital high-definition televisions.

These high speed interfaces use a differential signal system, transmitting differential signals (differential mode signals) using a pair of signal lines, unlike a single-end transmitting system that has been generally been used in the related art.

However, electronic devices that have been digitized implemented with higher speeds are sensitive to external stimuli, such that distortion of signals due to high frequency noise has often occurred.

A switching voltage generated in a circuit, power noise included in a power supply voltage, an unnecessary electromagnetic signal or electromagnetic noise, and the like, may be causes of such abnormal voltage and noise, and a common mode filter (CMF) has been used as a unit for preventing the above-mentioned abnormal voltage and high frequency noise from being introduced into the circuit.

Recently, in accordance with miniaturization and improvements in the performance of mobile components, it has been required to decrease a size of the common mode filter, while securing predetermined levels or more of performance and reliability in the common mode filter, even when the common mode filter is miniaturized, has been demanded.

For example, in accordance with a decrease in a size of a component, a size of an external electrode mounted on an SET substrate and electrically connected to the SET substrate, as well as a size of an internal coil of the common mode filter has been decreased. Therefore, a defect such as breakage of a connection portion between the internal coil and the external electrode or an increase in a level of resistance of the connection portion may occur after a reliability test or during an SET operation.

SUMMARY

An aspect of the present disclosure may provide a common mode filter capable of securing predetermined levels or more of performance and reliability even when miniaturized.

According to an aspect of the present disclosure, a multilayer common mode filter may include: a body including a coil part in which a plurality of coil layers including spiral coils are stacked in a thickness direction, wherein the plurality of coil layers have one lead portion connected to one of external electrodes disposed on the body and one or more dummy lead portions each connected to the other external electrodes, and the lead portion is connected to dummy lead portions of other coil layers stacked in the thickness direction in series.

According to another aspect of the present disclosure, a thin film type common mode filter may include: a coil part in which a plurality of spiral coils are disposed to face each other in a thickness direction, wherein the coil part has one lead portion connected to one of external electrodes and further has one or more dummy lead portions disposed on the same horizontal surface as a horizontal surface on which the lead portion is disposed, so as to be respectively connected to the other external electrodes per coil, and the lead portion is connected to dummy lead portions stacked to face the lead portion in the thickness direction in series.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Terms with respect to directions will be defined in order to clearly describe exemplary embodiments in the present disclosure. L, W, and T in the accompanying drawings refer to a length direction, a width direction, and a thickness direction, respectively.

Here, the thickness direction may be the same as a stacking direction in which coil layers are stacked.

Figure 1:
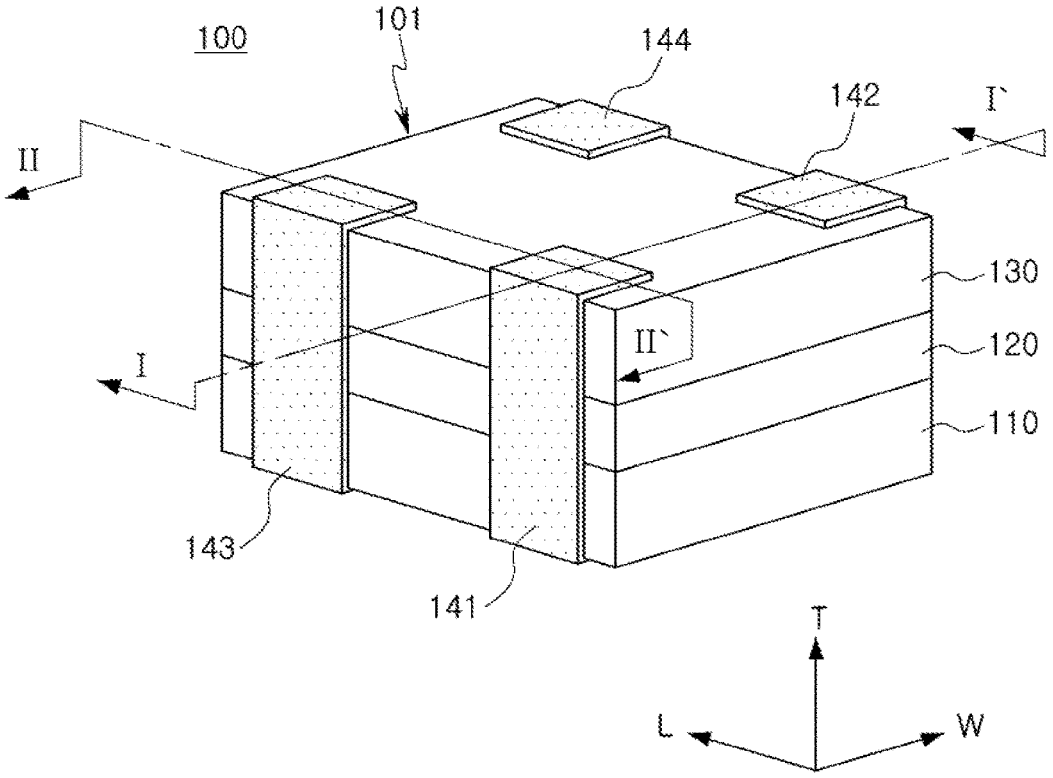
FIG. 1 is a perspective view illustrating a common mode filter according to an exemplary embodiment in the present disclosure.
Figure 2:
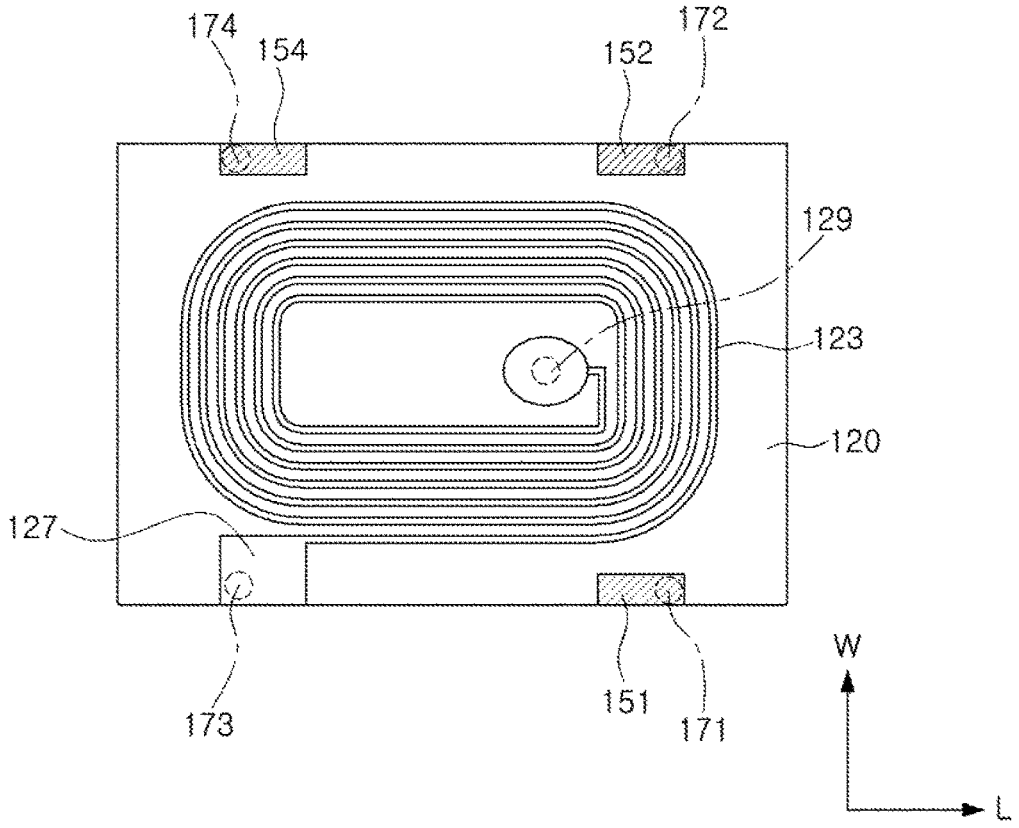
FIG. 2 is a plan view illustrating one coil layer in FIG. 1.
Figure 3:
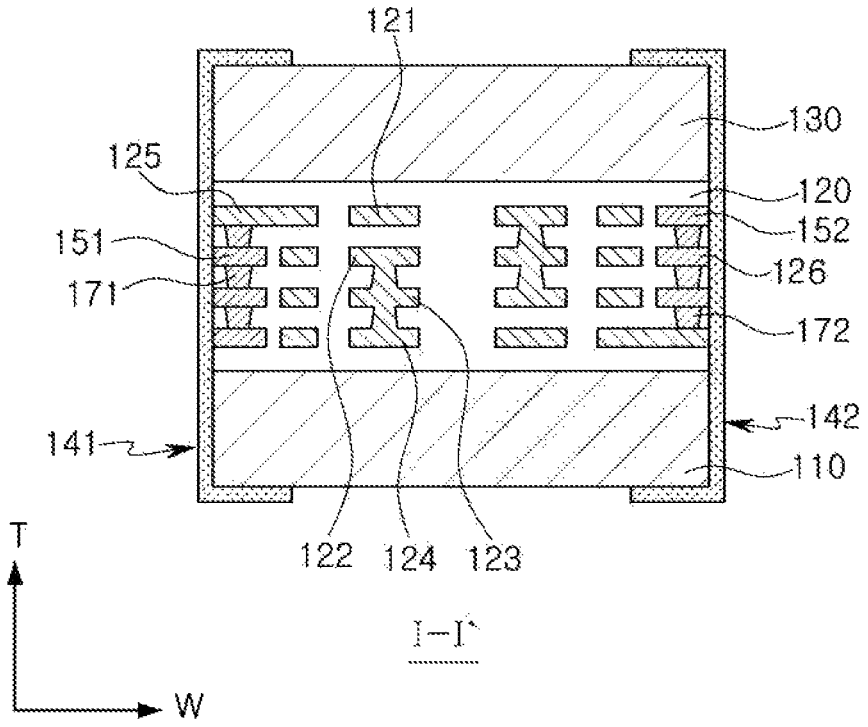
FIG. 3 is a cross-sectional view taken along line I-I' of FIG. 1.
Figure 4:
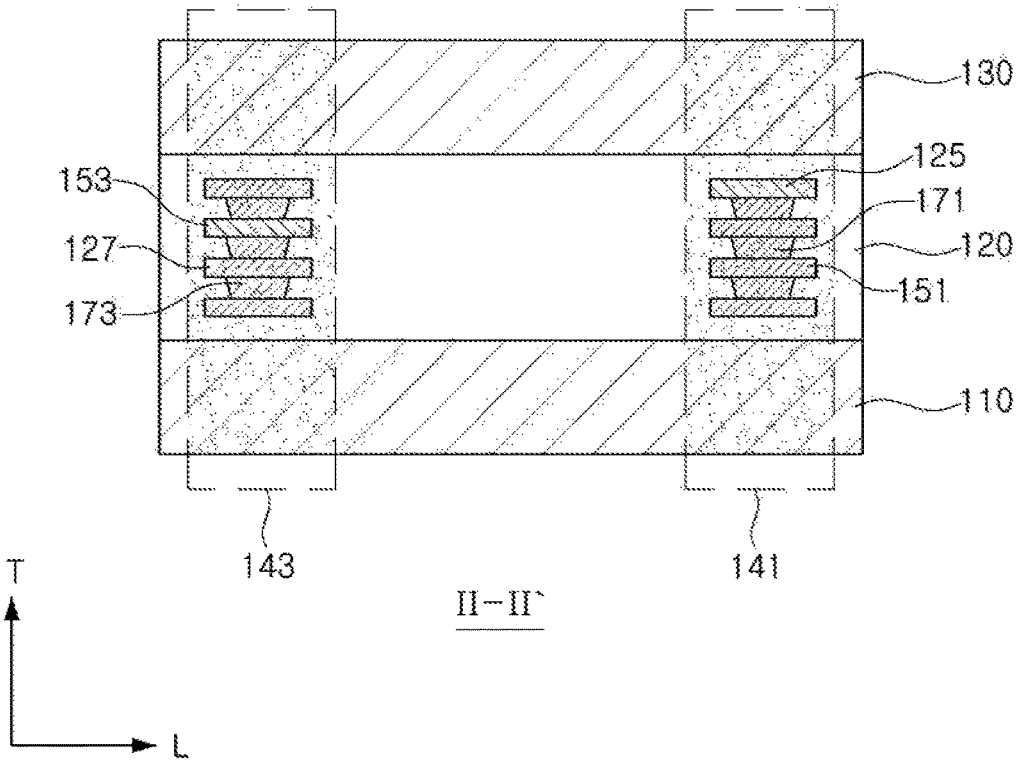
FIG. 4 is a cross-sectional view taken along line II-II' of FIG. 1.

FIG. 1 is a perspective view illustrating a common mode filter according to an exemplary embodiment in the present disclosure, FIG. 2 is a plan view illustrating one coil layer of FIG. 1, FIG. 3 is a cross-sectional view taken along line I-I' of FIG. 1, and FIG. 4 is a cross-sectional view taken along line II-II' of FIG. 1.

Referring to FIGS. 1 through 4, a common mode filter 100 according to an exemplary embodiment in the present disclosure may have a structure including a multilayer coil part, and may include a magnetic body 101 including a plurality of coil layers each having spiral coils disposed therein and a plurality of external electrodes 141, 142, 143, and 144 disposed on the magnetic body 101.

Here, the coil layer may have one lead portion connected to one of the external electrodes and one or more dummy lead portions each connected to the other external electrodes, and the lead portion may have a structure in which it is connected to dummy lead portions of other coil layers, stacked in the T direction, in series. Within the same coil layer and inside the magnetic body, the one of more dummy lead portions are electrically isolated from the spiral coils without considering any external electrodes.

Meanwhile, although a case in which four coil layers are stacked has been illustrated and described in the present exemplary embodiment, this is only an example. That is, the number of stacked coil layers may be three or less or five or more, if necessary, in the present disclosure.

In the present exemplary embodiment, the external electrodes may include first and third external electrodes 141 and 143 disposed on one surface of the magnetic body 101 in the width direction so as to be spaced apart from each other and second and fourth external electrodes 142 and 144 disposed on the other surface of the magnetic body 101 so as to face the first and third external electrodes 141 and 143, respectively.

Here, the first to fourth external electrodes 141 to 144 may include connection portions formed on one surface of the magnetic body 101 and band portions extending from the connection portions to portions of upper and lower surfaces of the magnetic body 101, respectively. Therefore, adhesive strength of the first to fourth external electrodes 141 to 144 may be improved.

The magnetic body 101 may include first and second magnetic bodies 110 and 130 and a coil part 120 including a plurality of coil layers.

Here, the first magnetic body 110 refers to a lower magnetic body positioned beneath the coil part 120, and the second magnetic body 130 refers to an upper magnetic body positioned on the coil part 120.

In addition, the first and second magnetic bodies 110 and 130 may be formed of a magnetic ceramic material, for example, one or more selected from the group consisting of Ni, Fe, Ni, Mn, Mg, Zn, Cu, Co, and the like, but are not limited thereto.

The coil layer may include an insulating layer, and may be formed by winding a conductive line formed of a conductive material one or more times on the insulating layer to form a coil in a spiral shape or forming a spiral coil using a conductive paste, a photo-resist method, or the like.

In the present exemplary embodiment, the coil layers may be formed by stacking four coils 121 to 124 through repetition of a process of forming a coil in a spiral shape on the insulating layer, compressing the insulating layer, and then forming another coil on the compressed insulating layer in the thickness direction.

Here, one end portions of the first to fourth coils 121 to 124 may be formed of lead portions exposed through one side surface of the magnetic body 101.

The first to fourth coils 121 to 124 disposed to face each other in the T direction may be electrically connected to each other by conductive vias 129 penetrating through the insulating layers.

In addition, the conductive vias 129 may be formed by forming via holes in the insulating layers by a laser punching method or a mechanical punching method and filling conductive materials in the via holes.

First to fourth lead portions each provided in the first to fourth coils 121 to 124 may contact and be electrically connected to the first to fourth external electrodes 141 to 144, respectively.

Hereinafter, the present disclosure will be described in relation to a third coil layer, and first, second, and fourth coil layers have a structure similar to that of the third coil layer.

As illustrated in FIG. 2, in the third coil layer, the third lead portion 127 of the third coil 123 may be disposed to be exposed through one surface of the magnetic body 101 in the width direction to thereby contact and be electrically connected to the third external electrode 143.

Here, a third conductive via 173 penetrating through the insulating layers vertically may be formed in the third lead portion 127.

The third conductive via 173 may contact third dummy lead portions 153 disposed to face the third lead portion 127 in the T direction to electrically connect the third lead portion 127 and the third dummy lead portions 153 to each other.

In addition, similarly, a first conductive via 171, a second conductive via 172, and a fourth conductive via 174 vertically penetrating through the insulating layers may be formed in the first lead portion 125, the second lead portion 126, and the fourth lead portion, respectively.

In addition, three lead portions, that is, first, second, and fourth dummy lead portions 151, 152, and 154 may be formed on the same insulating layer as the insulating layer on which the third lead portion 127 is formed.

The first, second, and fourth dummy lead portions 151, 152, and 154 may be disposed to be exposed through one surface of the magnetic body in the width direction, and may contact and be electrically connected to the first, second, and fourth external electrodes 141, 142, and 144, respectively.

Here, the first lead portion 125 and the first dummy lead portions 151 disposed to face the first lead portion 125 in the T direction may be electrically connected to each other by the first conductive via 171, the second lead portion 126 and the second dummy lead portions 152 disposed to face the second lead portion in the T direction may be electrically connected to each other by the second conductive via 172, and the fourth lead portion and the fourth dummy lead portions 154 disposed to face the fourth lead portion in the T direction may be electrically connected to each other by the fourth conductive via 174.

In addition, the first to fourth dummy lead portions 151 to 154 may be formed at the same thickness as that of the first to fourth lead portions. Therefore, generation of a crack and delamination due to a step may be prevented.

Recently, in accordance with miniaturization of a component, a common mode filter has been miniaturized. Therefore, it has been required that a width of an external electrode is 150 μm or less and an exposed width of a lead portion is 100 μm or less.

In addition, an exposed height of the lead portion is similar to a height of a coil, and is approximately 20 μm or less.

Therefore, in a case in which the common mode filter is miniaturized, a conductive paste for forming the external electrode is applied to a small area, such that a defect of electrical characteristics of the common mode filter may occur, and a problem that a contact portion between the lead portion and the external electrode is broken or a resistance of the connection portion is increased during an operation of the common mode filter due to a temperature rise and soldering stress at the time of performing SET mounting may occur even in a good product.

Referring to FIG. 3, the first lead portion 125 of the first coil 121 may be connected to the first dummy lead portions 151 formed at positions corresponding to the first lead portion 125 in the second to fourth coils 122 to 124, stacked in the thickness direction, in series through the conductive via 171, and both of the first lead portion 125 and the first dummy lead portions 151 may contact the first external electrode 141 on one surface of the magnetic body 101 in the width direction, such that a contact area between the lead portions including the first lead portion 125 and the first dummy lead portions 151 and the first external electrode 141 may be increased.

In addition, the second lead portion 126 of the second coil 122 may be connected to the second dummy lead portions 152 formed in positions corresponding to the second lead portion 126 in the first, third, and fourth coils 121, 123, and 124, stacked in the thickness direction, in series through the conductive via 172, and both of the second lead portion 126 and the second dummy lead portions 152 may contact the second external electrode 142 on the other surface of the magnetic body 101 in the width direction, such that a contact area between the lead portions including the second lead portion 126 and the second dummy lead portions 152 and the second external electrode 142 may be increased.

In addition, referring to FIG. 4, likewise, the third lead portion 127 of the third coil 123 may be connected to the third dummy lead portions 153 formed in positions corresponding to the third lead portion 127 in the first, second, and fourth coils 121, 122, and 124, stacked in the thickness direction, in series through the conductive via 173, and both of the third lead portion 127 and the third dummy lead portions 153 may contact the third external electrode 143 on one surface of the magnetic body 101 in the width direction, such that a contact area between the lead portions including the third dummy lead portions 153 may contact the third external electrode 143 and the third external electrode 143 may be increased.

Meanwhile, since a case of the fourth coil is similar to a case of the second coil, a detailed description for the case of the fourth coil will be omitted in order to avoid an overlapped description.

As described above, areas of portions at which the lead portions of the respective coils electrically contact the external electrodes corresponding to the lead portions are increased by the dummy lead portions connected to the lead portions in series by the conductive vias, even though widths of the external electrodes and exposed widths of the lead portions are limited due to miniaturization of the common mode filter, contact areas or volumes between the lead portions and the external electrodes may be secured to be as large as possible.

Therefore, a defect of electrical characteristics occurring at the time of applying a conductive paste for forming an external electrode in the related art may be prevented, and a problem in which a contact portion between the lead portion and the external electrode is broken or resistance of the connection portion is increased during an operation of the common mode filter due to a rise in temperature and soldering stress at the time of performing SET mounting in the related art may be prevented.

Meanwhile, a structure in which one lead portion and three dummy lead portions are vertically connected to each other through the conductive via in a case in which four coils are formed has been illustrated and described in the present exemplary embodiment.

Figure 5:
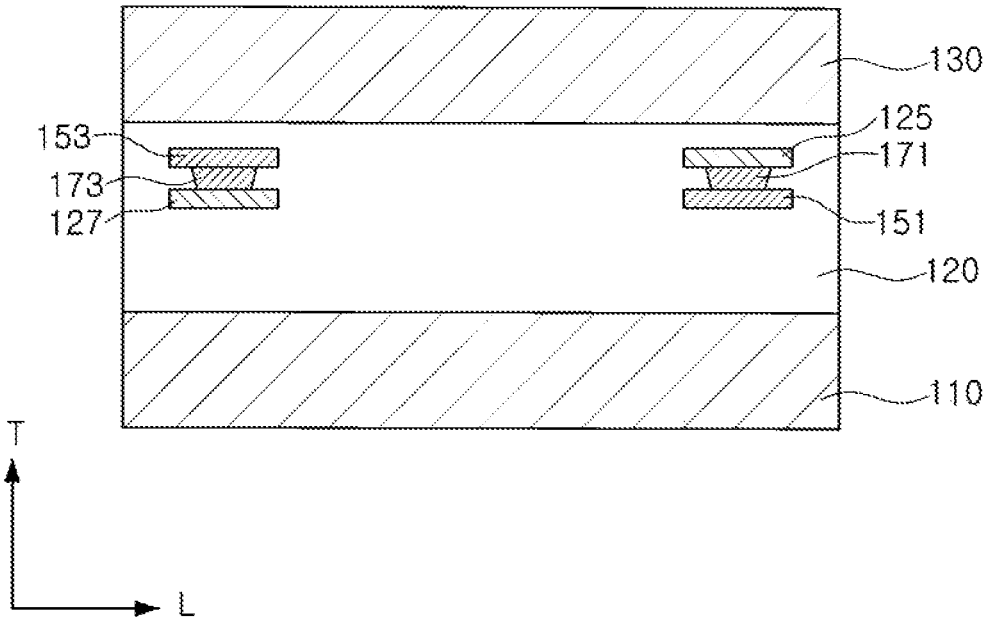
FIG. 5 is a cross-sectional view illustrating another example of a dummy lead portion in the common mode filter according to the present disclosure.

However, as illustrated in FIG. 5, the dummy lead portions according to the present disclosure are omitted in two coils, such that lead portions 127 and 125 may be connected to dummy lead portions 153 and 151 through conductive vias 173 and 171, respectively.

Figure 6:
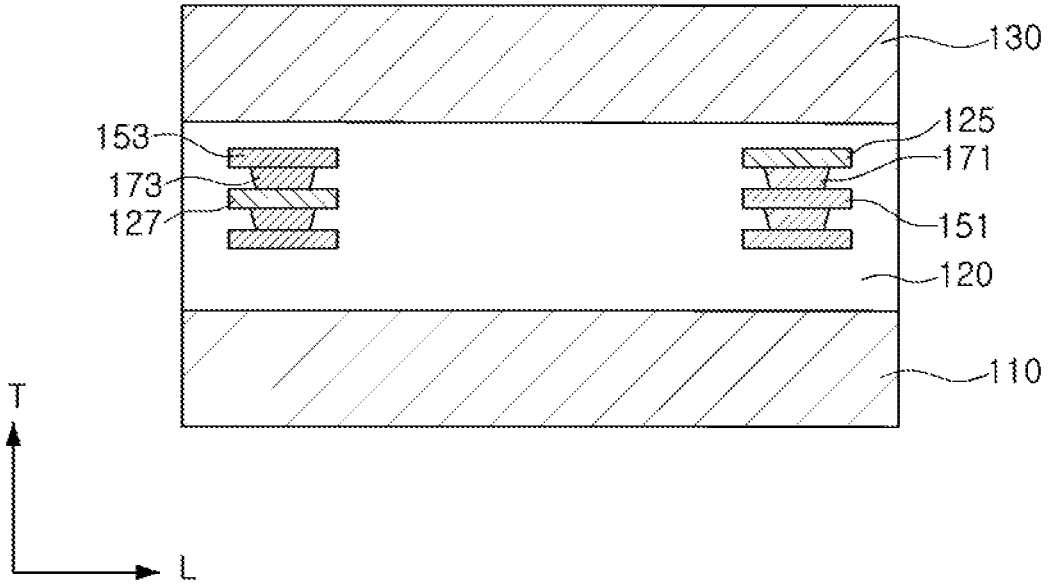
FIG. 6 is a cross-sectional view illustrating another example of a dummy lead portion in the common mode filter according to the present disclosure.

As another example, as illustrated in FIG. 6, the dummy lead portions are omitted in one coil, such that a third lead portion 127 may be vertically connected to two third dummy lead portions 153 through a conductive via 173 and a first lead portion 125 may be vertically connected to two first dummy lead portions 151 through a conductive via 171. In this case, the number of laser drilling processes may be additionally decreased.

Meanwhile, since a case of second and fourth lead portions is the same as the case described above, a detailed description thereof will be omitted in order to avoid an overlapped description.

Figure 7:
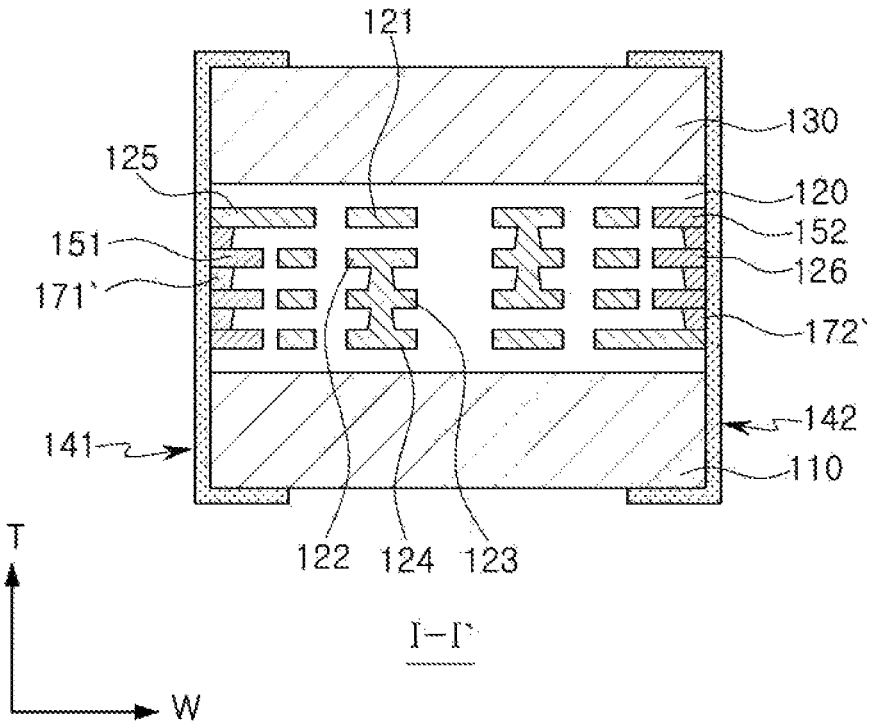
FIG. 7 is a cross-sectional view of another example of a conductive via taken along line I-I' in an exemplary embodiment in the present disclosure.

In addition, as another example, as illustrated in FIG. 7, conductive vias may be formed to be exposed through both surfaces of a magnetic body in the width direction to thereby contact and be electrically connected to the respective corresponding external electrodes.

First and second conductive vias 171' and 172' have been illustrated and described by way of example in FIG. 7, but a case of third and fourth lead portions may also be configured in the same form as the form described above.

When the conductive vias are configured to be exposed to the outside of the magnetic body, contact areas between the conductive vias and the external electrodes may be further increased to further improve electrical connectivity.

EXPERIMENTAL EXAMPLE

Common mode filters according to the Inventive Example and the Comparative Example were manufactured as described below.

First, a spiral coil was plated with copper (Cu) to form a coil layer, and an insulating layer was compressed on the coil layer.

Then, via holes were formed in portions in which the coil and dummy lead portions are exposed in the coil layer by laser drilling, and copper was filled in the via hole through plating to form conductive vias, thereby allowing upper and lower coils to be connected to each other.

The process described above was repeated to form a coil part including four layers.

Next, magnetic bodies were bonded to upper and lower portions of the coil part formed as described above, and were then separated into chips through a dicing process. In this case, lead portions of the coil part were also exposed.

Next, a conductive paste (Ag) was applied to portions in which the lead portions are exposed to form external electrodes, thereby manufacturing a common mode filter.

Hereinafter, Comparative Example refers to a common mode filter that does not include dummy lead portions by omitting a process of forming the dummy lead portions and has a 0605 size (length×width×height=0.65 mm×0.5 mm×0.3 mm), and Inventive Example refers to a common mode filter that includes three dummy lead portions per coil layer and has a 0605 size.

In addition, in Inventive Example, a width of the external electrode was set as 150 μm, a width of the portion in which the lead portion is exposed was set as 90 μm, and an exposed height of the lead portion is set as 13 μm.

The following Table 1 represents measurement results of Rdc in Comparative Example and Inventive Example.

TABLE 1

| Number of TEST Samples | Comparative Example: Before Common Mode Filter is Mounted Resistance [W] | Comparative Example: After Reflow Process is performed Three Times Resistance [W] | Inventive Example: Before Common Mode Filter is Mounted Resistance [W] | Inventive Example: After Reflow Process is performed Three Times Resistance [W] |
|---|---|---|---|---|
| 1 | 3.0 | 3.2 | 3.1 | 3.1 |
| 2 | 2.8 | 2.8 | 2.9 | 2.9 |
| 3 | 3.2 | 3.2 | 3.3 | 3.3 |
| 4 | 3.5 | 3.8 | 3.1 | 3.1 |
| 5 | 3.0 | 3.0 | 3.0 | 3.0 |
| 6 | 3.1 | 3.2 | 3.3 | 3.3 |
| 7 | 2.8 | 2.8 | 2.6 | 2.6 |
| 8 | 3.3 | 4.0 | 3.2 | 3.2 |
| 9 | 2.9 | 2.9 | 2.8 | 2.8 |
| 10 | 3.2 | 3.2 | 3.4 | 3.4 |
| 11 | 2.8 | 3.1 | 2.8 | 2.8 |
| 12 | 2.9 | 3.9 | 2.7 | 2.7 |
| 13 | 3.1 | 3.1 | 3.0 | 3.0 |
| 14 | 2.8 | 2.8 | 2.8 | 2.8 |
| 15 | 2.7 | 2.7 | 2.9 | 2.9 |
| 16 | 2.7 | 2.7 | 3.7 | 3.7 |
| 17 | 2.8 | 2.8 | 3.3 | 3.3 |
| 18 | 3.8 | open | 2.9 | 2.9 |
| 19 | 3.1 | 3.1 | 3.2 | 3.2 |
| 20 | 2.6 | 2.6 | 3.5 | 3.5 |

Referring to Table 1, in Comparative Example, when Rdc values were measured before a common mode filter is mounted and after a reflow process is performed three times, a case in which the Rdc value measured after the reflow process is performed three times is increased was confirmed in multiple samples (Samples 1, 4, 6, 11, 12, and 18).

However, in all samples of the Inventive Example, it might be confirmed that when Rdc values were measured before a common mode filter is mounted and after a reflow process is performed three times, the Rdc values measured before the common mode filter is mounted and after the reflow process is performed three times are the same as each other, such that an Rdc defect does not occur.

Hereinafter, the common mode filter according to the present disclosure may be configured in a thin film type structure rather than a multilayer structure.

For example, the common mode filter according to the present exemplary embodiment may include a coil part in which a plurality of spiral coils are disposed to face each other in the T direction, a magnetic sheet is disposed on the coil part, and a magnetic substrate is disposed beneath the coil part.

That is, in the common mode filter according to the present exemplary embodiment, the magnetic sheet disposed beneath the coil part in the exemplary embodiment described above is replaced by a magnetic substrate, and the coil part configured in a multilayer structure is replaced by a coil part in an integral structure.

Here, a detailed description of components that are the same as the components according to the exemplary embodiment described above will be omitted in order to avoid an overlapped description.

As set forth above, in the common mode filter according to an exemplary embodiment in the present disclosure, the lead portion and one or more dummy lead portions may be disposed on each coil layer, and the lead portion and dummy lead portions corresponding to the lead portion in the thickness direction are connected to each other in series to increase a contact area between the lead portion and the external electrode, whereby electrical connectivity of the common mode filter may be improved and a defective rate of Rdc (a direct current (DC) resistance value) may be improved.

While exemplary embodiments have been shown and described above, it will be apparent to those skilled in the art that modifications and variations could be made without departing from the scope of the present invention as defined by the appended claims.

What is claimed is:

1. A common mode filter comprising:

a body including a first magnetic body, a coil part disposed on the first magnetic body and including a plurality of coil layers including spiral coils and stacked in a thickness direction, and a second magnetic body disposed on the coil part; and a plurality of external electrodes disposed on two surfaces of the body opposing each other so that the plurality of external electrodes face each other, wherein one of the plurality of coil layers has a lead portion connected to one of the external electrodes and one or more dummy lead portions each connected to the other external electrodes, and the lead portion of the one of the plurality of coil layers is connected, at least through conductive vias passing through insulating layers which separate the plurality of coil layers from each other in the thickness direction, to dummy lead portions of other coil layers stacked in the thickness direction in series, the conductive vias are spaced apart from the plurality of external electrodes, each of the conductive vias has a size smaller than each of the lead portion and the dummy lead portions of the other coil layers, and the conductive vias are aligned with each other in the thickness direction.

2. The common mode filter of claim 1, wherein the external electrodes include first and third external electrodes disposed on one surface of the body so as to be spaced apart from each other and second and fourth external electrodes disposed on the other surface of the body so as to face the first and third external electrodes, respectively, and the coil part includes first to fourth coil layers each having first and fourth lead portions respectively connected to the first to fourth external electrodes.

3. The common mode filter of claim 2, wherein the first to fourth external electrodes extend from one surface of the body onto portions of two surfaces of the body opposing each other in the thickness direction.

4. The common mode filter of claim 1, wherein a distance, in the thickness direction, between the lead portion of the one of the plurality of coil layers and a dummy lead portion of another one of the plurality of coil layers adjacent to the one of the plurality of coil layers is substantially equal to a distance, in the thickness direction, between a spiral coil of the one of the plurality of coil layers and a spiral coil of the another one of the plurality of coil layers.

* * * * *